US010889881B2

(12) United States Patent
Suzuki et al.

(10) Patent No.: US 10,889,881 B2
(45) Date of Patent: Jan. 12, 2021

(54) ALUMINUM ALLOY PIPE WITH SUPERIOR CORROSION RESISTANCE AND PROCESSABILITY, AND METHOD FOR MANUFACTURING SAME

(71) Applicants: UACJ CORPORATION, Tokyo (JP); UACJ EXTRUSION CORPORATION, Tokyo (JP)

(72) Inventors: Taichi Suzuki, Tokyo (JP); Hidenori Hatta, Tokyo (JP); Takumi Ishizaka, Nagoya (JP)

(73) Assignees: UACJ CORPORATION, Tokyo (JP); UACJ EXTRUSION CORPORATION, Tokyo (JP)

( * ) Notice: Subject to any disclaimer, the term of this patent is extended or adjusted under 35 U.S.C. 154(b) by 511 days.

(21) Appl. No.: 15/563,694

(22) PCT Filed: Apr. 1, 2016

(86) PCT No.: PCT/JP2016/060950

§ 371 (c)(1),
(2) Date: Oct. 2, 2017

(87) PCT Pub. No.: WO2016/159361

PCT Pub. Date: Oct. 6, 2016

(65) Prior Publication Data

US 2018/0073119 A1 Mar. 15, 2018

(30) Foreign Application Priority Data

Apr. 3, 2015 (JP) ..... 2015-076777

(51) Int. Cl.

| | |
|---|---|
| ***C22F 1/047*** | (2006.01) |
| ***C22C 21/06*** | (2006.01) |
| ***B21C 23/00*** | (2006.01) |
| ***B21C 23/08*** | (2006.01) |
| ***C22C 21/08*** | (2006.01) |

(52) U.S. Cl.

CPC ..... *C22F 1/047* (2013.01); *B21C 23/00* (2013.01); *C22C 21/06* (2013.01); *C22C 21/08* (2013.01); *B21C 23/085* (2013.01)

(58) Field of Classification Search

None

See application file for complete search history.

(56) References Cited

U.S. PATENT DOCUMENTS

| | | | | |
|---|---|---|---|---|
| 5,464,340 | A * | 11/1995 | Yano | B21C 23/002 425/382.3 |
| 2003/0164207 | A1* | 9/2003 | Kashiwazaki | B21C 23/215 148/440 |
| 2015/0059426 | A1* | 3/2015 | Sung | B21C 25/00 72/68 |

FOREIGN PATENT DOCUMENTS

| | | | |
|---|---|---|---|
| CN | 102465221 | A | 5/2012 |
| JP | 5-7927 | A | 1/1993 |
| JP | 10-137837 | A | 5/1998 |
| JP | 2003-105474 | A | 4/2003 |
| JP | 2003-226928 | A | 8/2003 |

OTHER PUBLICATIONS

International Search Report dated Jul. 5, 2016, issued in counterpart of International Application No. PCT/JP2016/060950 (1 page).

Office Action dated Dec. 5, 2018, issued in counterpart Chinese Application No. 201680019473.3, with English translation (14 pages).

Extended (supplementary) European Search Report dated Sep. 27, 2018, issued in counterpart European Application No. 16773241.1 (7 pages).

* cited by examiner

*Primary Examiner* — Colleen P Dunn
*Assistant Examiner* — Michael J Kachmarik
(74) *Attorney, Agent, or Firm* — Westerman, Hattori, Daniels & Adrian, LLP

(57) ABSTRACT

An aluminum alloy pipe produced by porthole extrusion includes: Mg at a concentration equal to or higher than 0.7% (mass %, the same applies hereinafter) and lower than 1.5%; Ti at a concentration higher than 0% and equal to or lower than 0.15%; with the balance being Al and unavoidable impurities. As the unavoidable impurities, Si has a limited concentration of 0.20% or lower, Fe 0.20% or lower, Cu 0.05% or lower, Mn 0.10% or lower, Cr 0.10% or lower, and Zn 0.10% or lower. Difference between the maximum value and the minimum value of the Mg concentration in a lengthwise direction of the pipe is 0.2% or lower, and the average crystal grain size in a cross-section perpendicular to the lengthwise direction is 300 μm or smaller.

An aluminum alloy pipe used for piping or hose joints and having excellent strength, corrosion resistance, and processability can be provided.

10 Claims, No Drawings

ALUMINUM ALLOY PIPE WITH SUPERIOR CORROSION RESISTANCE AND PROCESSABILITY, AND METHOD FOR MANUFACTURING SAME

TECHNICAL FIELD

The present invention relates to an aluminum alloy pipe used for piping or hose joints, for example, and having excellent corrosion resistance and processability, and a method for manufacturing the same.

BACKGROUND ART

Conventionally, as aluminum alloy pipe materials such as piping material and hose joint material, extruded pipes of 1000 series (pure aluminum series), 3000 series (Al—Mn series), 6000 series (Al—Mg—Si series) aluminum alloys have been used.

Examples of an extrusion method for manufacturing such extruded pipes include a mandrel extrusion and a porthole extrusion. In the mandrel extrusion, a stem equipped with a mandrel is used to extrude a hollow billet into a circular pipe. In the porthole extrusion, extrusion is performed using a hollow die including in combination a male die having port holes for dividing a material and a mandrel for forming a hollow portion and a female die having a chamber for welding together the divided material in a manner surrounding the mandrel. However, an extruded pipe produced by the mandrel extrusion has problems in that, for example, uneven thickness is more likely to occur and it is difficult to mold a thin pipe. Thus, for aluminum alloy pipes such as piping material or hose joint material, it is preferable that extruded pipes be produced by the porthole extrusion.

For the conventional aluminum alloys described above, either of the extrusion methods can be used, and the porthole extrusion can be used to produce an extruded pipe having a predetermined shape. However, for example, 1000 series aluminum materials do not satisfy a requirement for high strength, 3000 series aluminum alloy materials may have a reduced corrosion resistance due to excessive precipitation of Mn, and 6000 series aluminum alloy materials have many restrictions in manufacturing processes because this series is of a heat treatment type, and thus it is difficult to manufacture such extruded pipes from these aluminum materials because of the respective material characteristics.

In contrast, 5000 series (Al—Mg series) aluminum alloys have material characteristics excellent in strength, corrosion resistance, and processability, for example. However, the porthole extrusion cannot be usually used for 5000 series alloys because of high hardness thereof, and hollow pipes are extruded and molded usually by the mandrel extrusion. Although some attempts to mold 5000 series aluminum alloys by the porthole extrusion have been proposed, these attempts are not always satisfactory because a special die structure is required therein and there are restrictions in cross-sectional dimensions of extruded pipes, for example.

CITATION LIST

Patent Literature

[Patent Literature 1] Japanese Patent Application Publication No. 2003-105474

[Patent Literature 2] Japanese Patent Application Publication No. 2003-226928

SUMMARY OF INVENTION

Technical Problem

The present invention has been made based on the fact that porthole extrusion of 5000 series aluminum alloys is enabled by adjusting alloy contents and preferably specifying extrusion conditions in order to solve the conventional problems described above in aluminum alloy pipes used for piping or hose joints, for example. It is an object thereof to provide a 5000 series aluminum alloy pipe having excellent strength and corrosion resistance and also having excellent processability.

Solution to Problem

An aluminum alloy pipe with excellent corrosion resistance and processability according to claim 1 in order to achieve the object described above is an aluminum alloy pipe produced by porthole extrusion and including: Mg at a concentration equal to or higher than 0.7% and lower than 1.5%; Ti at a concentration higher than 0% and equal to or lower than 0.15%; with the balance being Al and unavoidable impurities. As the unavoidable impurities, Si has a limited concentration of 0.20% or lower, Fe has a limited concentration of 0.20% or lower, Cu has a limited concentration of 0.05% or lower, Mn has a limited concentration of 0.10% or lower, Cr has a limited concentration of 0.10% or lower, and Zn has a limited concentration of 0.10% or lower. The aluminum alloy pipe is characterized in that difference between a maximum value and a minimum value of the concentration of Mg in a lengthwise direction of the pipe is 0.2% or lower, and an average crystal grain size in a cross-section perpendicular to the lengthwise direction of the pipe is 300 μm or smaller. In the following description, all alloy contents are expressed in terms of mass %.

An aluminum alloy pipe with excellent corrosion resistance and processability according to claim 2 is an aluminum alloy pipe obtained by additionally subjecting the aluminum alloy pipe produced by porthole extrusion described in claim 1 to drawing, and is characterized in that the difference between the maximum value and the minimum value of the concentration of Mg in the lengthwise direction of the pipe is 0.2% or lower, and the average crystal grain size in a cross-section perpendicular to the lengthwise direction of the pipe is 300 μm or smaller.

An aluminum alloy pipe with excellent corrosion resistance and processability according to claim 3 is an aluminum alloy pipe obtained by additionally annealing the aluminum alloy pipe produced by porthole extrusion described in claim 1, and is characterized in that the difference between the maximum value and the minimum value of the concentration of Mg in the lengthwise direction of the pipe is 0.2% or lower, and the average crystal grain size in a cross-section perpendicular to the lengthwise direction of the pipe is 300 μm or smaller.

An aluminum alloy pipe with excellent corrosion resistance and processability according to claim 4 is an aluminum alloy pipe obtained by additionally annealing the aluminum alloy pipe subjected to drawing described in claim 2, and is characterized in that the difference between the maximum value and the minimum value of the concentration of Mg in the lengthwise direction of the pipe is 0.2% or lower, and the average crystal grain size in a cross-section perpendicular to the lengthwise direction of the pipe is 300 μm or smaller.

A method for manufacturing an aluminum alloy pipe with excellent corrosion resistance and processability according to claim 5 is a method for manufacturing the aluminum alloy pipe described in claim 1. The method is characterized in that a billet of an aluminum alloy including: Mg at a concentration equal to or higher than 0.7% and lower than 1.5%; Ti at a concentration higher than 0% and equal to or lower than 0.15%; with the balance being Al and unavoidable impurities; Si at a limited concentration of 0.20% or lower, Fe at a limited concentration of 0.20% or lower, Cu at a limited concentration of 0.05% or lower, Mn at a limited concentration of 0.10% or lower, Cr at a limited concentration of 0.10% or lower, and Zn at a limited concentration of 0.10% or lower. The billet is homogenized at a temperature of 450° C. to 570° C. for four hours or longer, and then porthole extrusion is performed at an extrusion temperature of 400° C. to 550° C. on the billet homogenized. The homogenization temperature is more preferably 500 to 560° C.

A method for manufacturing an aluminum alloy pipe with excellent corrosion resistance and processability according to claim 6 is a method for manufacturing the aluminum alloy pipe described in claim 2, and is characterized in that an aluminum alloy extruded pipe produced by the method for manufacturing described in claim 5 is subjected to drawing at a reduction rate in which reduction in area is higher than 0% and equal to or lower than 70%.

A method for manufacturing an aluminum alloy pipe with excellent corrosion resistance and processability according to claim 7 is a method for manufacturing the aluminum alloy pipe described in claim 3 or 4, and is characterized in that the aluminum alloy pipe produced by the method for manufacturing described in claim 5 or 6 is annealed at a temperature of 300 to 560° C.

A method for manufacturing an aluminum alloy pipe with excellent corrosion resistance and processability according to claim 8 is characterized in that, in any one of claims 5 to 7, the porthole extrusion is performed at an extrusion ratio of 10 to 200 such that thickness of the pipe extruded becomes 0.5 to 10 mm.

Advantageous Effects of Invention

According to the present invention, a 5000 series aluminum alloy pipe having excellent strength and corrosion resistance and also having excellent processability and a method for manufacturing the same can be provided. This aluminum alloy pipe has such excellent processability that no crack occurs therein when inner surfaces thereof are brought into intimate contact with each other in a flattening test, and no crack occurs from a welded portion thereof in a pipe-expansion test. By the method for manufacturing according to the present invention, excellent extrudability can be obtained, and processing heat generation during extrusion can be suppressed. Consequently, the crystal grain size of the extruded pipe can be reduced, and a pipe material having excellent processability that enables processing with no rough surfaces, for example, being formed can be obtained.

DESCRIPTION OF EMBODIMENTS

An aluminum alloy pipe according to the present invention is produced by performing porthole extrusion on a billet to be extruded made of an aluminum alloy having a predetermined composition.

The significance of alloy contents of the aluminum alloy pipe according to the present invention and reasons for specifying the alloy contents will be described hereinafter.

Mg functions to increase strength, and the content thereof is preferably within a range equal to or higher than 0.7% and lower than 1.5%. If the content is lower than 0.7%, the strength thereof becomes equivalent to that of 1000 series alloys, and a strength that is generally required for piping material cannot be obtained. If the content is equal to or higher than 1.5%, the extrusion pressure during porthole extrusion increases, which adversely affects extrudability. By setting the content of Mg to 0.7% or higher and lower than 1.5%, a strength required for piping material, for example, can be obtained, and also hot deformation resistance during extrusion does not increase above a level during conventional mandrel extrusion, and thus excellent extrudability can be obtained. Processing heat during extrusion can be suppressed, and thus the crystal grain size of an extruded pipe can be reduced. Specifically, the average crystal grain size in a cross-section perpendicular to the lengthwise direction of the extruded pipe can be reduced to 300 μm or smaller, and a pipe material having excellent processability that enables processing with no rough surfaces, for example, being formed can be obtained. The content range of Mg is more preferably 0.7% to 1.3%.

Ti is added as a structure refiner for achieving a finer cast structure, for example. The content thereof is preferably within a range higher than 0% and equal to or lower than 0.15%. If Ti is not contained, the cast structure becomes coarse and heterogeneous like feathery crystals, and thus coarse crystal grains may be partially formed in the structure of the extruded pipe, or the solid solution state of added elements may become heterogeneous. If Ti is contained more than 0.15%, a large crystallized product may be formed, and thus a surface defect, for example, may occur during extrusion, or a crack or a cut may be more likely to occur from the large crystallized product as a starting point during drawing, which may adversely affect the processability as a product. The content range of Ti is more preferably 0.01 to 0.05%.

In the present invention, as unavoidable impurities, Si has a limited content of 0.20% or lower, Fe has a limited content of 0.20% or lower, Cu has a limited content of 0.05% or lower, Mn has a limited content of 0.10% or lower, Cr has a limited content of 0.10% or lower, and Zn has a limited content of 0.10% or lower.

If the Si content exceeds 0.20%, an $Mg_2Si$ compound is excessively formed, whereby the corrosion resistance is reduced. If the Fe content exceeds 0.20%, an $Al_3Fe$ compound is excessively precipitated, whereby the corrosion resistance is reduced. If the Cu content exceeds 0.05%, grain boundary corrosion susceptibility increases, and accordingly the corrosion resistance decreases.

If the Mn content exceeds 0.10%, the corrosion resistance is adversely affected when excessive precipitation proceeds. If the Cr content exceeds 0.10%, recrystallization becomes heterogeneous because Cr suppresses the recrystallization, and thus the processability as a product is more likely to decrease. If the Zn content exceeds 0.10%, general corrosion proceeds and the amount of corrosion increases, whereby the corrosion resistance is reduced.

Other impurities other than the unavoidable impurities Si, Fe, Cu, Mn, Cr, and Zn described above may be contained within a range that does not affect the effects of the present invention, and the content of each of the other impurities may be 0.05% or lower, and the total content thereof may be 0.15% or lower.

The aluminum alloy pipe according to the present invention can be used in a form of an extruded pipe produced by porthole extrusion as a first embodiment, can be used in a form of the extruded pipe produced by porthole extrusion that is additionally subjected to drawing process as a second embodiment, can be used in a form of the extruded pipe that is additionally annealed as a third embodiment, and can be used in a form of the extruded pipe that is additionally annealed after the drawing process as a fourth embodiment.

In the present invention, in all of the first to fourth embodiments, the difference between the maximum value and the minimum value of the Mg concentration in the lengthwise direction of the aluminum alloy pipe is preferably 0.2% or lower. If the difference between the maximum value and the minimum value of the Mg concentration exceeds 0.2%, the strength may partially vary, which may cause partial defects during bending processing or pipe-expansion processing when the aluminum alloy pipe is cut into a useful size to be used for piping, for example.

In all of the first to fourth embodiments, in the aluminum alloy pipe according to the present invention, the average crystal grain size in a cross-section perpendicular to the lengthwise direction of the aluminum alloy pipe is preferably 300 μm or smaller. If the average crystal grain size in a cross-section perpendicular to the lengthwise direction exceeds 300 μm, the processability decreases, which may cause defects such as rough surfaces during processing such as bending or pipe-expansion. The average crystal grain size in a cross-section perpendicular to the lengthwise direction of the aluminum alloy pipe is more preferably 200 μm or smaller.

The following describes a method for manufacturing the aluminum alloy pipe according to the present invention.

Molten metal of an aluminum alloy having the composition described above is casted into an ingot in accordance with a conventional method, the obtained ingot (billet) is homogenized, and then the billet is heated again for extrusion. Porthole extrusion is performed such that the thickness of the resulting pipe after the extrusion has a specified dimension, whereby an extruded pipe is produced (first embodiment). The extruded pipe is additionally subjected to drawing as the second embodiment, the extruded pipe is additionally annealed as the third embodiment, and the extruded pipe is additionally annealed after the drawing as the fourth embodiment.

The homogenization of the ingot (billet) is preferably performed at a temperature range of 450° C. to 570° C. for four hours or longer. If the homogenization temperature is lower than 450° C. or if the homogenization time is shorter than four hours, microsegregation in the ingot structure of the billet cannot be eliminated due to shortage of diffusion energy. Consequently, the difference between the maximum value and the minimum value of the Mg concentration in the lengthwise direction of the aluminum alloy pipe exceeds 0.2% after the extrusion (first embodiment), after the drawing (second embodiment), and after the annealed (third and fourth embodiments), and also partial heterogeneity of the strength occurs, which makes processability such as bending processability and pipe-expansion processability more likely to decrease. If the homogenization temperature exceeds 570° C., a solidus or higher temperature is reached, which may cause the billet to be partially melt. The homogenization temperature is more preferably 500 to 560° C. Although the homogenization for four hours or longer provides required performance, the homogenization is preferably performed practically for 20 hours or shorter from the viewpoint of manufacturing cost.

The porthole extrusion is preferably performed at a temperature of 400° C. to 550° C. If the extrusion temperature is lower than 400° C., the extrusion pressure increases, which may make the extrusion difficult to be performed. If the extrusion temperature exceeds 550° C., a gauge defect is more likely to occur in the aluminum alloy pipe extruded during the extrusion.

In the present invention, by combining the alloy composition, the homogenization conditions, and the extrusion temperature conditions, hot deformation resistance during extrusion is reduced, and the extrusion pressure accordingly decreases. Thus, the average crystal grain size in a direction perpendicular to the lengthwise direction (extrusion direction) of the extruded and molded aluminum alloy pipe can be reduced to 300 μm or smaller, whereby the aluminum alloy pipe having excellent bending processability and pipe-expansion processability and also having excellent processability that enables processing with no defects such as rough surfaces can be manufactured.

The extrusion ratio in the extrusion process is preferably 10 to 200. If the extrusion ratio is lower than 10, welding of metal in a welded portion becomes insufficient, which makes a crack more likely to occur from the welded portion after the extrusion. If the extrusion ratio exceeds 200, the extrusion pressure increases, which may make the extrusion difficult to be performed.

The porthole extrusion is preferably performed such that the thickness of the aluminum alloy pipe after the extrusion becomes 0.5 to 10 mm. If the pipe thickness is smaller than 0.5 mm, the extrusion pressure increases, which may make the extrusion difficult to be performed. If the pipe thickness is greater than 10 mm, welding of the extruded pipe becomes insufficient depending on the extrusion ratio.

The extrusion ratio and the pipe thickness are smaller than the respective lower limits or exceed the respective upper limits, the pressure during extrusion increases, and consequently processing heat generation during extrusion increases, and the crystal grain size of the extruded and molded aluminum alloy pipe accordingly increases. In the present invention, by specifying the extrusion ratio and the pipe thickness after extrusion, an aluminum alloy pipe with excellent processability and excellent corrosion resistance can be more reliably obtained.

In the second embodiment, the aluminum alloy pipe produced by porthole extrusion is additionally subjected to drawing. The drawing after the extrusion is preferably performed at a reduction rate in which reduction in area is higher than 0% and 70% or lower. If the reduction in area exceeds 70%, cold processing rate increases, which may make the drawing difficult to be processed.

In the third embodiment, the extruded pipe is additionally annealed, and in the fourth embodiment, the aluminum alloy pipe that has been subjected to the drawing is additionally annealed. This annealing is preferably performed at a temperature range of 300 to 5600° C. for a period longer than zero hours and equal to or shorter than three hours. If the annealing temperature is lower than 300° C., annealing becomes insufficient and the strength becomes partially heterogeneous, and thus processability such as bending processability and pipe-expansion processability decreases. If the annealing temperature is higher than 560° C. or if the annealing time is longer than three hours, the crystal grain size excessively grows over 300 μm, which may cause defects such as rough surfaces during processing such as bending or pipe-expansion.

EXAMPLES

Hereinafter, Examples of the present invention will be described in comparison with Comparative Examples, and the effects of the present invention will be verified. These Examples merely demonstrate one embodiment of the present invention, and thus the present invention is not limited to these.

Example 1, Comparative Example 1

Aluminum alloys A to L having compositions given in Table 1 were melted, and were casted into ingots each in a billet shape having a diameter of 196 mm by continuous casting. After the obtained billets were homogenized at 500° C. for eight hours, porthole extrusion was performed on each resulting billet at a temperature of 420° C. into a pipe shape having an outer diameter of 52 mm and a thickness of 2 mm (container diameter: 200 mm, extrusion ratio: 100). In Table 1, values that do not satisfy the conditions of the present invention are underlined.

These extruded aluminum alloy pipes were used as test materials (1 to 12), and in accordance with the following methods, corrosion resistance, processability, strength, crystal grain size, and difference between the maximum value and the minimum value of Mg concentration in the lengthwise direction (extrusion direction) were evaluated. The results are given in Table 2.

Extruded pipes of the aluminum alloys A to C were additionally subjected to drawing (reduction in area: 48%) such that each pipe has an outer diameter of 40 mm and a thickness of 1.4 mm, and the resulting pipes were used as test materials (13 to 15). In the same manner, corrosion resistance, processability, strength, crystal grain size, and difference between the maximum value and the minimum value of Mg concentration in the lengthwise direction (extrusion direction) were evaluated. The results are given in Table 2.

Furthermore, an extruded pipe of the aluminum alloy A and a drawn pipe of the aluminum alloy A were annealed at a temperature of 420° C. for 1.5 hours, and the resulting pipes were used as test materials (16 to 17). In the same manner, corrosion resistance, processability, strength, crystal grain size, and difference between the maximum value and the minimum value of Mg concentration in the lengthwise direction (extrusion direction) were evaluated. The results were given in Table 2.

TABLE 1

| Alloy | Si | Fe | Cu | Mn | Mg | Cr | Zn | Ti | Al |
|---|---|---|---|---|---|---|---|---|---|
| A | 0.15 | 0.05 | 0.04 | 0.07 | 0.77 | 0.08 | 0.08 | 0.03 | bal. |
| B | 0.15 | 0.11 | 0.03 | 0.07 | 1.28 | 0.05 | 0.06 | 0.14 | bal. |
| C | 0.15 | 0.09 | 0.03 | 0.08 | 1.49 | 0.05 | 0.07 | 0.05 | bal. |
| D | 0.14 | 0.10 | 0.03 | 0.08 | 0.61 | 0.08 | 0.08 | 0.01 | bal. |
| E | 0.13 | 0.06 | 0.04 | 0.09 | 2.85 | 0.07 | 0.09 | 0.02 | bal. |
| F | 0.23 | 0.10 | 0.02 | 0.07 | 1.31 | 0.08 | 0.07 | 0.01 | bal. |
| G | 0.12 | 0.25 | 0.04 | 0.08 | 1.44 | 0.06 | 0.09 | 0.03 | bal. |
| H | 0.12 | 0.11 | 0.07 | 0.07 | 1.51 | 0.07 | 0.06 | 0.02 | bal. |
| I | 0.14 | 0.08 | 0.04 | 0.13 | 1.47 | 0.08 | 0.07 | 0.04 | bal. |
| J | 0.10 | 0.10 | 0.03 | 0.06 | 1.61 | 0.14 | 0.08 | 0.03 | bal. |
| K | 0.15 | 0.15 | 0.04 | 0.07 | 1.73 | 0.07 | 0.13 | 0.01 | bal. |
| L | 0.13 | 0.12 | 0.03 | 0.09 | 1.13 | 0.08 | 0.05 | 0.19 | bal. |

<Note>
Alloy contents are expressed in terms of mass %.

Corrosion resistance: From a central portion of each test material in the lengthwise direction, a sample having a length of 120 mm was cut. Both ends of the sample were masked, and a CASS test according to JIS Z-2371 was performed on the sample for 1000 hours. On each sample after the test, acid rinsing was performed by following a procedure specified in the test method to remove a corrosion product. The maximum corrosion depth was measured by a focal depth method, and each sample in which perforation occurred is classified as failed (x).

Flattening test: From a central portion of each test material in the lengthwise direction, a sample having a length of 20 mm was cut. The sample was sandwiched between iron plates, and was compressed at a pressing speed of 5 mm/min in a direction perpendicular to the lengthwise direction until the inner surfaces of the pipe were brought into contact with each other (a tensile testing machine was used, and the test was conducted using a compression mode). Based on the presence or absence of a crack, bending processability was evaluated. Each sample in which no crack occurred is classified as passed (○), and each sample in which a crack occurred is classified as failed (x).

Pipe-expansion test: From a central portion of each test material in the lengthwise direction, a sample having a length of 20 mm was cut. A 90° cone was inserted into the sample at a speed of 5 mm/min in the lengthwise direction (the tensile testing machine was used, and the test was conducted using the compression mode). Based on the presence or absence of a crack, strength of a material welded portion during extrusion was evaluated. Each sample in which no crack occurred in a welded portion is classified as passed (○), and each sample in which a crack occurred in a welded portion is classified as failed (x).

Mechanical property: From a central portion of each test material in the lengthwise direction, a sample was cut to prepare a JIS No. 11 test piece, and tensile testing was conducted according to JIS Z-2241 to evaluate a mechanical property. Each sample having a strength suitable for piping material (tensile strength: 95 MPa or higher, proof stress: 50 MPa or higher) is classified as passed.

Material structure: From a central portion of each test material in the lengthwise direction (a portion at 4000 mm from the extrusion head portion of an extruded pipe, a portion at 5920 mm from the head portion in the lengthwise direction of the pipe after being drawn, and a portion at 6000 mm from the head portion in the lengthwise direction of the pipe after being annealed), a sample having a length of 20 mm was cut, and a cross-section perpendicular to the lengthwise direction was observed. Each sample was ground and then etched, and images of optional three visual fields thereof were captured at a 50-fold magnification with a polarizing microscope. Crystal grain sizes were measured by an intersection method, and the average thereof was used.

Difference of Mg concentration in the lengthwise direction (extrusion direction): Mg concentrations were measured by emission spectrophotometer at six points at 2000-mm intervals from a portion at 1000 mm from the head portion of each of the pipes after being extruded, after being subjected to drawing, and after being annealed. The difference between the maximum value and the minimum value of Mg concentration was evaluated.

TABLE 2

| Test material | Alloy | Corrosion depth (μm) | Flattening | Pipe expansion | Ts (MPa) | Ys (MPa) | Crystal grain size (μm) | Mg concentration difference (mass %) |
|---|---|---|---|---|---|---|---|---|
| 1 | A | 934 | ○ | ○ | 106 | 61 | 183 | 0.11 |
| 2 | B | 855 | ○ | ○ | 121 | 72 | 114 | 0.09 |
| 3 | C | 821 | ○ | ○ | 143 | 84 | 99 | 0.12 |
| 4 | B | 1089 | ○ | ○ | 82 | 48 | 252 | 0.09 |
| 5 | E | 881 | ○ | X | 225 | 88 | 92 | 0.10 |
| 6 | F | X | ○ | ○ | 123 | 66 | 181 | 0.10 |
| 7 | G | X | ○ | ○ | 131 | 59 | 150 | 0.08 |
| 8 | H | X | ○ | ○ | 157 | 63 | 136 | 0.13 |
| 9 | I | X | ○ | ○ | 160 | 61 | 144 | 0.05 |
| 10 | J | 883 | X | ○ | 158 | 65 | 220 | 0.09 |
| 11 | K | X | ○ | ○ | 172 | 70 | 112 | 0.14 |
| 12 | L | 867 | ○ | ○ | 117 | 67 | 203 | 0.11 |
| 13 | A | 901 | ○ | ○ | 122 | 70 | 120 | 0.11 |
| 14 | B | 832 | ○ | ○ | 139 | 83 | 78 | 0.09 |
| 15 | C | 889 | ○ | ○ | 164 | 97 | 71 | 0.12 |
| 16 | A | 922 | ○ | ○ | 101 | 55 | 195 | 0.12 |
| 17 | A | 894 | ○ | ○ | 113 | 64 | 142 | 0.08 |

As indicated in Table 2, every one of the test materials 1 to 3 (first embodiment), 13 to 15 (second embodiment), 16 (third embodiment), and 17 (fourth embodiment) according to the present invention had excellent strength and corrosion resistance, and had such excellent processability that no crack occurred when the inner surfaces were brought into contact with each other in the flattening test and no crack occurred from a welded portion in the pipe-expansion test.

In contrast, the test material 4 had a strength equivalent to that of 1000 series (pure aluminum series) because the Mg content was low, and a strength generally required for piping material was not able to be obtained. In the test material 5, welding of metal during extrusion was insufficient because the Mg content was high, and a crack occurred in the pipe-expansion test.

Because the content of the Si was high in the test material 6, the content of Fe was high in the test material 7, and the content of Mn was high in the test material 9, and because the content of Cu was high in the test material 8 and the content of Zn was high in the test material 11, perforation occurred in all of these test materials in the corrosion resistance evaluation.

In the test material 10, recrystallization was heterogeneous because the content of Cr was high, and thus the processability as a product may decrease. In the test material 12, a large crystallized product was formed and a surface defect occurred during extrusion because the content of Ti was high. Thus, there is concern that a crack or a cut may occur during drawing and the processability as a product may decrease.

Example 2, Comparative Example 2

An aluminum alloy having a composition of the alloy B in Table 1 was melted, and was casted by continuous casting into billets for extrusion having billet diameters given in Table 3 and Table 4. The obtained billets were homogenized under conditions given in Table 3 and Table 4, and each billet was extruded and molded into a pipe shape by tubularly performing porthole extrusion.

In order to obtain products of the second embodiment, some of the extruded pipes were subjected to drawing at the reductions in area given in Table 3 and Table 4. In order to obtain products of the third and fourth embodiments, some of the extruded pipes and the drawn pipes were annealed for 1.5 hours at temperatures given in Table 3 and Table 4.

These obtained aluminum alloy pipes were used as test materials, by the same methods as in Example 1, corrosion resistance, processability, strength, crystal grain size, difference between the maximum value and the minimum value of Mg concentration in the lengthwise direction (extrusion direction) were evaluated. The results are given in Table 5. In evaluation of the difference between the maximum value and the minimum value of Mg concentration in the lengthwise direction, Mg concentrations were measured by emission spectrophotometer at five points at 1500-mm intervals from a portion at 1000 mm from the head portion of each of the extruded pipes and the pipes annealed after being extruded, and at five points at 2500-mm intervals from a portion at 1000 mm from the head portion of each of the drawn pipes and the pipes annealed after being drawn. The difference between the maximum value and the minimum value of Mg concentration was measured.

TABLE 3

| Manufacturing condition | Homogenization temperature × time (° C. × h) | Extrusion temperature (° C.) | Billet diameter (mm) | Extrusion cross-section shape[1)] (mm) | Extrusion ratio | Drawing reduction rate (%) | Annealing temperature (° C.) |
|---|---|---|---|---|---|---|---|
| a | 500 × 8 | 500 | 196 | ϕ52 × 2 | 100 | — | — |
| b | 500 × 8 | 500 | 196 | ϕ52 × 2 | 100 | — | 330 |
| c | 500 × 8 | 500 | 196 | ϕ52 × 2 | 100 | — | 500 |
| d | 500 × 8 | 500 | 196 | ϕ52 × 2 | 100 | 48 | — |
| e | 500 × 8 | 500 | 196 | ϕ52 × 2 | 100 | 48 | 330 |
| f | 500 × 8 | 500 | 196 | ϕ52 × 2 | 100 | 48 | 500 |
| g | 550 × 4 | 500 | 196 | ϕ52 × 2 | 100 | — | — |

TABLE 3-continued

| Manufacturing condition | Homogenization temperature × time (° C. × h) | Extrusion temperature (° C.) | Billet diameter (mm) | Extrusion cross-section shape[1)] (mm) | Extrusion ratio | Drawing reduction rate (%) | Annealing temperature (° C.) |
|---|---|---|---|---|---|---|---|
| h | 500 × 8 | 410 | 196 | φ52 × 2 | 100 | — | — |
| i | 500 × 8 | 550 | 196 | φ52 × 2 | 100 | — | — |
| j | 500 × 8 | 500 | 196 | φ52 × 2 | 100 | 68 | — |
| k | 500 × 8 | 500 | 196 | φ52 × 2 | 100 | 5 | — |
| α | 460 × 8 | 450 | 196 | φ52 × 2 | 100 | 48 | 500 |
| β | 570 × 4 | 500 | 196 | φ52 × 2 | 100 | 48 | 500 |
| γ | 560 × 4 | 500 | 196 | φ52 × 2 | 100 | 48 | 500 |

[1)]outer diameter × thickness

TABLE 4

| Manufacturing condition | Homogenization temperature × time (° C. × h) | Extrusion temperature (° C.) | Billet diameter (mm) | Extrusion cross-section shape[1)] (mm) | Extrusion ratio | Drawing reduction rate (%) | Annealing temperature (° C.) |
|---|---|---|---|---|---|---|---|
| l | 385 × 8 | 440 | 196 | φ52 × 2 | 100 | 48 | — |
| m | 578 × 8 | 433 | 196 | φ52 × 2 | 100 | — | — |
| n | 550 × 2 | 500 | 100 | φ52 × 2 | 100 | 48 | — |
| o | 472 × 8 | 382 | 196 | φ52 × 2 | 100 | — | — |
| p | 465 × 8 | 560 | 196 | φ52 × 2 | 100 | — | — |
| q | 525 × 8 | 462 | 87 | φ52 × 0.4 | 100 | — | — |
| r | 531 × 4 | 458 | 435 | φ52 × 11 | 22 | — | — |
| s | 522 × 8 | 451 | 56 | φ52 × 2 | 9 | — | — |
| t | 530 × 8 | 448 | 286 | φ52 × 2 | 210 | — | — |
| u | 528 × 8 | 455 | 196 | φ52 × 2 | 100 | 78 | — |
| v | 500 × 8 | 500 | 196 | φ52 × 2 | 100 | — | 280 |
| w | 500 × 8 | 500 | 196 | φ52 × 2 | 100 | 48 | 280 |
| x | 500 × 8 | 500 | 196 | φ52 × 2 | 100 | — | 565 |
| y | 500 × 8 | 500 | 196 | φ52 × 2 | 100 | 48 | 565 |

[1)]outer diameter × thickness

TABLE 5

| Test material | Manufacturing condition | Corrosion depth (μm) | Flattening | Pipe expansion | Ts (MPa) | Ys (MPa) | Crystal grain size (μm) | Mg concentration difference (mass %) |
|---|---|---|---|---|---|---|---|---|
| 21 | a | 855 | ○ | ○ | 121 | 72 | 114 | 0.09 |
| 22 | b | 869 | ○ | ○ | 111 | 62 | 142 | 0.07 |
| 23 | c | 904 | ○ | ○ | 102 | 53 | 224 | 0.06 |
| 24 | d | 832 | ○ | ○ | 139 | 83 | 78 | 0.09 |
| 25 | e | 921 | ○ | ○ | 115 | 66 | 111 | 0.07 |
| 26 | f | 866 | ○ | ○ | 109 | 56 | 201 | 0.06 |
| 27 | g | 899 | ○ | ○ | 120 | 69 | 120 | 0.07 |
| 28 | h | 876 | ○ | ○ | 125 | 73 | 116 | 0.09 |
| 29 | i | 881 | ○ | ○ | 118 | 67 | 159 | 0.08 |
| 30 | j | 901 | ○ | ○ | 168 | 92 | 54 | 0.08 |
| 31 | k | 873 | ○ | ○ | 132 | 77 | 103 | 0.09 |
| 32 | α | 873 | ○ | ○ | 119 | 70 | 149 | 0.12 |
| 33 | β | 885 | ○ | ○ | 105 | 57 | 172 | 0.07 |
| 34 | γ | 842 | ○ | ○ | 124 | 61 | 139 | 0.05 |

As indicated in Table 5, every one of the test materials 21 and 27 to 29 (first embodiment), 24 and 30 to 34 (second embodiment), 22 to 23 (third embodiment), and 25 to 26 (fourth embodiment) according to the present invention had excellent strength and corrosion resistance, and had such excellent processability that no crack occurred when the inner surfaces were brought into contact with each other in the flattening test and no crack occurred from a welded portion in the pipe-expansion test.

In contrast, among the test materials manufactured under the manufacturing conditions given in Table 4, in each of the test material of the manufacturing condition 1 and the test material of the manufacturing condition "n", microsegregation in the ingot structure of the billet failed to be eliminated, and the difference between the maximum value and the minimum value of Mg concentration in the lengthwise direction (extrusion direction) exceeded 0.2%. This is because the homogenization temperature was low in the condition 1 and the homogenization time was short in the condition "n".

In the test material of the manufacturing condition "m", the billet was partially melted because the homogenization temperature was high, and thus extrusion failed. In the test material of the manufacturing condition "o", the extrusion pressure became high because the extrusion temperature was low, which made extrusion difficult to be performed. In the test material of the manufacturing condition "p", gauge defect was formed in the extruded pipe because the extrusion temperature was high.

In the test material of the manufacturing condition "q", the extrusion pressure became high because the thickness of the extruded pipe was small, which made extrusion difficult to be performed. In the test material of the manufacturing condition "r", welding of metal in a welded portion during extrusion was insufficient because the thickness of the extruded pipe was great and the extrusion ratio was low, and a crack occurred in the extruded pipe.

In the test material of the manufacturing condition "s", welding of metal in a welded portion during extrusion was insufficient because the extrusion ratio was low, and a crack occurred in the extruded pipe. In the test material of the manufacturing condition "t", the extrusion pressure became high because the extrusion ratio was high, which made extrusion difficult to be performed.

The test materials of the manufacturing conditions "m" and "o" to "t" were not subjected to drawing, and manufacturing thereof was canceled. In the test material of the manufacturing condition "u", drawing was difficult to be performed due to work hardening because the drawing reduction rate was high, and thus manufacture of a product pipe failed.

In the test materials of the manufacturing conditions "v" and "w", annealing was not completed and a structure to be processed partially remained because the annealing temperature was low at 280° C., and thus the strength may partially become heterogeneous and the processability as a product may decrease. In the test materials of the manufacturing conditions "x" and "y", the average crystal grain sizes excessively grew over 300 μm respectively reaching 383 μm and 321 μm because the annealing temperature was high at 565° C., and thus there was concern that defects such as rough surfaces might occur during processing such as bending or pipe expansion.

The invention claimed is:

1. An aluminum alloy pipe produced by porthole extrusion, the aluminum alloy pipe comprising: Mg at a concentration equal to or higher than 0.7% (mass %, the same applies to the following) and lower than 1.5%; Ti at a concentration higher than 0% and equal to or lower than 0.15%; with the balance being Al and unavoidable impurities, as the unavoidable impurities, Si having a limited concentration of 0.20% or lower, Fe having a limited concentration of 0.20% or lower, Cu having a limited concentration of 0.05% or lower, Mn having a limited concentration of 0.10% or lower, Cr having a limited concentration of 0.10% or lower, and Zn having a limited concentration of 0.10% or lower, wherein difference between a maximum value and a minimum value of the concentration of Mg in a lengthwise direction of the pipe is 0.2% or lower, and an average crystal grain size in a cross-section perpendicular to the lengthwise direction of the pipe is 300 μm or smaller.

2. The aluminum alloy pipe according to claim 1, wherein the aluminum alloy pipe produced by porthole extrusion is additionally subjected to drawing, and the difference between the maximum value and the minimum value of the concentration of Mg in the lengthwise direction of the pipe is 0.2% or lower, and the average crystal grain size in a cross-section perpendicular to the lengthwise direction of the pipe is 300 μm or smaller.

3. The aluminum alloy pipe according to claim 1, wherein the aluminum alloy pipe produced by porthole extrusion is additionally annealed, and the difference between the maximum value and the minimum value of the concentration of Mg in the lengthwise direction of the pipe is 0.2% or lower, and the average crystal grain size in a cross-section perpendicular to the lengthwise direction of the pipe is 300 μm or smaller.

4. The aluminum alloy pipe according to claim 2, wherein the aluminum alloy pipe subjected to drawing is additionally annealed, and the difference between the maximum value and the minimum value of the concentration of Mg in the lengthwise direction of the pipe is 0.2% or lower, and the average crystal grain size in a cross-section perpendicular to the lengthwise direction of the pipe is 300 or smaller.

5. A method for manufacturing the aluminum alloy pipe as claimed in claim 1, the method comprising: a billet of an aluminum alloy including: Mg at a concentration equal to or higher than 0.7% and lower than 1.5%; Ti at a concentration higher than 0% and equal to or lower than 0.15%; with the balance being Al and unavoidable impurities; Si at a limited concentration of 0.20% or lower, Fe at a limited concentration of 0.20% or lower, Cu at a limited concentration of 0.05% or lower, Mn at a limited concentration of 0.10% or lower, Cr at a limited concentration of 0.10% or lower, and Zn at a limited concentration of 0.10% or lower, homogenizing of the billet at a temperature of 450° C. to 570° C. for four hours or longer, and then performing porthole extrusion at an extrusion temperature of 400° C. to 550° C. on the billet homogenized.

6. A method for manufacturing the aluminum alloy pipe as claimed in claim 2, the method comprising: a billet of an aluminum alloy including: Mg at a concentration equal to or higher than 0.7% and lower than 1.5%; Ti at a concentration higher than 0% and equal to or lower than 0.15%; with the balance being Al and unavoidable impurities; Si at a limited concentration of 0.20% or lower, Fe at a limited concentration of 0.20% or lower, Cu at a limited concentration of 0.05% or lower, Mn at a limited concentration of 0.10% or lower, Cr at a limited concentration of 0.10% or lower, and Zn at a limited concentration of 0.10% or lower, homogenizing of the billet at a temperature of 450° C. to 570° C. for four hours or longer, then performing porthole extrusion at an extrusion temperature of 400° C. to 550° C. on the billet homogenized to produce an aluminum alloy extruded pipe, and subjecting the aluminum alloy extruded pipe to drawing at a reduction rate in which reduction in area is higher than 0% and equal to or lower than 70%.

7. A method for manufacturing the aluminum alloy pipe as claimed in claim 3, the method comprising: a billet of an aluminum alloy including: Mg at a concentration equal to or higher than 0.7% and lower than 1.5%; Ti at a concentration higher than 0% and equal to or lower than 0.15%; with the balance being Al and unavoidable impurities; Si at a limited concentration of 0.20% or lower, Fe at a limited concentration of 0.20% or lower, Cu at a limited concentration of 0.05% or lower, Mn at a limited concentration of 0.10% or lower, Cr at a limited concentration of 0.10% or lower, and Zn at a limited concentration of 0.10% or lower, homogenizing of the billet at a temperature of 450° C. to 570° C. for four hours or longer, then performing porthole extrusion at an extrusion temperature of 400° C. to 550° C. on the billet homogenized to produce an aluminum alloy extruded pipe, and annealing the aluminum alloy pipe at a temperature of 300 to 560° C.

8. The method for manufacturing an aluminum alloy pipe according to claim 5, the method comprising: performing the porthole extrusion at an extrusion ratio of 10 to 200 such that thickness of the pipe extruded becomes 0.5 to 10 mm.

9. The method for manufacturing an aluminum alloy pipe according to claim 6, the method comprising: performing the porthole extrusion at an extrusion ratio of 10 to 200 such that thickness of the pipe extruded becomes 0.5 to 10 mm.

10. The method for manufacturing an aluminum alloy pipe according to claim 7, the method comprising: performing the porthole extrusion at an extrusion ratio of 10 to 200 such that thickness of the pipe extruded becomes 0.5 to 10 mm.

* * * * *